United States Patent [19]

Buongiorne et al.

[11] Patent Number: 4,975,357

[45] Date of Patent: Dec. 4, 1990

[54] METHOD OF PHOTOGRAPHIC COLOR DEVELOPMENT USING POLYHYDROXY COMPOUNDS, METAL IONS AND SEQUESTERING AGENTS

[75] Inventors: Jean M. Buongiorne, Brockport; Janet M. Huston, Rochester; Paul A. Schwartz, Webster; Sheridan E. Vincent, Rochester, all of N.Y.

[73] Assignee: Eastman Kodak Company, Rochester, N.Y.

[21] Appl. No.: 355,732

[22] Filed: May 23, 1989

[51] Int. Cl.[5] ..... G03C 7/30; G03C 7/26

[52] U.S. Cl. ..... 430/434; 430/447; 430/464; 430/467; 430/484; 430/485; 430/490; 430/491; 430/607

[58] Field of Search ..... 430/434, 464, 467, 484, 430/485, 490, 491, 607, 447

[56] References Cited

U.S. PATENT DOCUMENTS

| | | | |
|---|---|---|---|
| 3,236,652 | 2/1966 | Kennard et al. | 430/607 |
| 3,746,544 | 7/1973 | Heilmann | 430/491 |
| 3,994,730 | 11/1976 | Frank et al. | 96/66 |
| 4,264,716 | 4/1981 | Vincent et al. | 430/380 |
| 4,482,626 | 11/1984 | Twist et al. | 430/380 |
| 4,892,804 | 1/1990 | Vincent et al. | 430/491 |
| 4,906,554 | 3/1990 | Ishikawa et al. | 430/491 |

FOREIGN PATENT DOCUMENTS

| | | | |
|---|---|---|---|
| 878675 | 10/1961 | United Kingdom | 430/491 |
| 87/04534 | 7/1987 | World Int. Prop. O. . | |

*Primary Examiner*—Richard L. Schilling
*Assistant Examiner*—Patrick A. Doody
*Attorney, Agent, or Firm*—Alfred P. Lorenzo

[57] ABSTRACT

Hydroxylamine compounds are commonly included in photographic color developing solutions to retard aerial oxidation. When the photographic element processed in the color developing solution is one which contains an aromatic polyhydroxy compound which serves as a stabilizing addendum, there will be a build-up of the level of such compound in the developing solution as seasoning occurs. Also, as a consequence of seasoning, there is a gradual build-up of the level of trace metal impurities in the solution. Interaction of a trace metal impurity with the aromatic polyhydroxy compound can form a metal-complex which catalyzes the oxidation of the hydroxylamine compound and thereby renders it ineffective for its intended purpose. In the improved method of this invention, the color developing solution is protected against the unwanted metal-complex catalyzed oxidation by incorporation therein of an aminopolycarboxylic acid sequestering agent.

10 Claims, No Drawings

METHOD OF PHOTOGRAPHIC COLOR DEVELOPMENT USING POLYHYDROXY COMPOUNDS, METAL IONS AND SEQUESTERING AGENTS

BACKGROUND OF THE INVENTION

1. Field of the Invention

This invention relates in general to color photography and in particular to a new and improved method of photographic color development. More specifically, this invention relates to color development with a color developing composition, containing a primary aromatic amino color developing agent and an hydroxylamine compound, which is protected against metal-complex catalyzed oxidation of the hydroxylamine compound.

2. Description of the Prior Art

The formation of color photographic images by the image-wise coupling of oxidized primary aromatic amino developing agents with color forming or coupling compounds to form indoaniline, indophenol and azomethine dyes is well known. In these processes, the subtractive process of color formation is ordinarily used and the image dyes customarily formed are cyan, magenta, and yellow, the colors that are complementary to the primary colors, red, green, and blue, respectively. Usually phenol or naphthol couplers are used to form the cyan dye image; pyrazolone or cyanoacetyl derivative couplers are used to form the magenta dye image; and acylacetamide couplers are used to form the yellow dye image.

In these color photographic systems, the color forming coupler may be either in the developer solution or incorporated in the light-sensitive photographic emulsion layer so that, during development, it is available in the emulsion layer to react with the color developing agent that is oxidized by silver image development. Diffusible couplers are used in color developer solutions. Non-diffusing couplers are incorporated in photographic emulsion layers. When the dye image formed is to be used in situ, couplers are selected which form non-diffusing dyes. For image transfer color processes, couplers are used which will produce diffusible dyes capable of being mordanted or fixed in the receiving sheet.

In addition to a primary aromatic amino color developing agent, photographic color developing compositions frequently contain an hydroxylamine compound which functions to protect the developing agent against aerial oxidation. They also generally contain a sequestering agent to stabilize the composition against precipitation of metal salts or hydroxides and against undesired decomposition reactions, such as the decomposition of the hydroxylamine compound to generate ammonia or amines. A variety of sequestering agents or combinations of sequestering agents have been proposed in the past for use in stabilizing photographic color developing compositions containing a primary aromatic amino color developing agent and an hydroxylamine compound. For example, sequestering agents described as being useful for this purpose include the 1,3-diamino-2-propanol tetraacetic acid of U.S. Pat. No. 2,875,049; the diethylenetriamine pentaacetic acid of U.S. Pat. No. 3,462,269; the combination of an aminopolycarboxylic acid and an aromatic polyhydroxy compound of U.S. Pat. No. 3,746,544; and combination of an amino-N,N-dimethylenephosphonic acid and a diphosphonic acid described in Research Disclosure, Volume 134, Item 13410, June 1975; the combination of an hydroxyalkylidene diphosphonic acid and an aminopolycarboxylic acid or of an hydroxylalkylidenediphosphonic acid and an aminopolyphosphonic acid of U.S. Pat. No. 3,994,730; the organic compounds having at least one phosphono group and at least one carboxy group in the molecule described in U.S. Pat. No. 4,083,723; the combination of an aminophosphonic acid and an aminocarboxylic acid described in Research Disclosure, Volume 170, Item 17048, June 1978; and the combination of an aromatic polyhydroxy compound and an aminopolyphosphonic acid compound of U.S. Pat. No. 4,264,716.

It is well known in the photographic art to include aromatic polyhydroxy compounds in photographic color elements as stabilizing addenda. Such use of these compounds is described, for example, in Kennard et al U.S. Pat. No. 3,236,652 issued Feb. 22, 1966. It is also common for trace amounts of metal impurities to be present in photographic elements. Thus, for example, trace amounts of metals such as iron and manganese are often present as impurities in gelatin.

During the processing of photographic color elements, both trace metal impurities and aromatic polyhydroxy compounds utilized as stabilizing addenda can be leached from the photographic element and accumulate as seasoning products in the developing solution. As a result, the aromatic polyhydroxy compound can form a complex with the trace metal impurity and this metal-complex has the undesirable property of catalyzing oxidation of the hydroxylamine compound. This renders the hydroxylamine compound ineffective with regard to its intended function of protecting the developing solution against aerial oxidation.

It is toward the objective of providing a means of developing photographic color elements, which contain trace metal impurities and also contain polyhydroxy compounds, without excessive loss of the hydroxylamine compound incorporated in the developing solution that the present invention is directed.

SUMMARY OF THE INVENTION

In accordance with this invention, it has been discovered that addition to a photographic color developing solution of an aminopolycarboxylic acid sequestering agent is effective in preventing the metal-complex catalyzed oxidation of an hydroxylamine compound. Thus, the invention comprises an improved method of color development in which a photographic element containing at least one trace metal impurity and at least one aromatic polyhydroxy compound which functions therein as a stabilizing addendum is developed in a color developing solution comprising a primary aromatic amino color developing agent, at least one hydroxylamine compound and a sufficient amount of an aminopolycarboxylic acid sequestering agent to prevent metal-complex catalyzed oxidation of the hydroxylamine compound.

DESCRIPTION OF THE PREFERRED EMBODIMENTS

The primary aromatic amino color developing agents that are utilized in the compositions and methods of this invention are well known and widely used in a variety of color photographic processes. They include aminophenols and p-phenylenediamines. They are usually used in the salt form, such as the hydrochloride or sulfate, as the salt form is more stable than the free amine, and are generally employed in concentrations of from about 0.1 to about 20 grams per liter of developing solution and more preferably from about 0.5 to about 10 grams per liter of developing solution.

Examples of aminophenol developing agents include 0-aminophenol, p-aminophenol, 5-amino-2-hydroxy-toluene, 2-amino-3-hydroxy-toluene, 2-hydroxy-3-amino-1,4-dimethylbenzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride,
4-N,N-diethyl-2-methylphenylenediamine monohydrochloride,
4-(N-ethyl-N-2-methanesulfonylaminoethyl)-2-methylphenylenediamine sesquisulfate monohydrate,
4-(N-ethyl-N-2-hydroxyethyl)-2-methylphenylenediamine sulfate,
4-N,N-diethyl-2,2'-methanesulfonylaminoethylphenylenediamine hydrochloride,
and the like.

An especially preferred class of p-phenylenediamine developing agents are those containing at least one alkylsulfonamidoalkyl sustitutent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxyalkyl-p-phenylenediamines. These developing agents are described in U.S. Pat. Nos. 3,656,950 and 3,658,525, and can be represented by the formula:

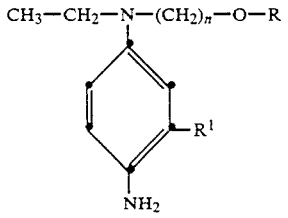

wherein n is an integer having a value of from about 2 to 4, R is an alkyl group of from 1 to 4 carbon atoms, and $R^1$ is an alkyl group of from 1 to 4 carbon atoms or an alkoxy group of from 1 to 4 carbon atoms. Illustrative examples of these developing agents include the following compounds:

N-ethyl-N-methoxybutyl-3-methyl-p-phenylenediamine,
N-ethyl-N-ethoxyethyl-3-methyl-p-phenylenediamine,
N-ethyl-N-methoxyethyl-3-n-propyl-p-phenylenediamine,
N-ethyl-N-methoxyethyl-3-methoxy-p-phenylenediamine,
N-ethyl-N-butoxyethyl-3-methyl-p-phenylenediamine,
and the like.

In addition to the primary aromatic amino color developing agent, the developing compositions utilized in the method of this invention contain a hydroxylamine compound. The hydroxylamine compound can be substituted or unsubstituted. Examples of substituted hydroxylamines include the mono-alkyl substituted hydroxylamines and the N-N-dialkylhydroxylamines. The hydroxylamine compound can be used in the color developing composition in the form of the free amine, but is more typically employed in the form of a water-soluble acid salt. Typical examples of such salts are sulfates, oxalates, chlorides, phosphates, carbonates, acetates, and the like.

The N,N-dialkylhydroxylamines are preferred for use in this invention especially those of the formula:

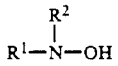

wherein $R^1$ and $R^2$ represent the same or different alkyl groups of 1 to 4 carbon atoms.

Typical examples of N,N-dialkylhydroxylamines include:

N,N-diethylhydroxylamine,
N-ethyl-N-methylhydroxylamine,
N-ethyl-N-propylhydroxylamine,
N,N-dipropylhydroxylamine,
N-methyl-N-butylhydroxylamine,
and the like.

The method of the present invention is especially adapted for use with photographic silver halide color elements which contain aromatic polyhydroxy compounds as stabilizing addenda. Preferably, the aromatic polyhydroxy compound is a compound having at least two hydroxy groups in ortho-position in relation to each other on an aromatic ring. Most preferably, it is a compound which has at least two hydroxy groups in ortho-position in relation to each other on an aromatic carbocyclic ring and which is free of exocyclic unsaturation. Included within the broad class of aromatic polyhydroxy compounds which are useful in this invention are, for example, compounds of the benzene series and of the naphthalene series, which can be represented by the formula:

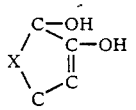

where X represents the carbon atoms necessary to complete the benzene or naphthalene aromatic ring structure. In addition to the hydroxy substituents, the aromatic ring structure can be substituted with groups such as sulfo radicals, carboxy radicals, or halogen atoms. Typical examples of aromatic polyhydroxy compounds useful in this invention include the following compounds:

pyrocatechol,
4,5-dihydroxybenzene-1,3-disulfonic acid,
4,5-dihydroxybenzene-1,3-disulfonic acid disodium salt,
tetrabromopyrocatechol,
pyrogallol,
gallic acid,
methyl gallate,
propyl gallate,
2,3-dihydroxynaphthalene-6-sulfonic acid,
2,3,8-trihydroxynaphthalene-6-sulfonic acid,
and the like.

The problem which this invention solves is to provide an effective means of color development for photographic elements which contain one or more trace metal impurities and one or more of the aforesaid aromatic polyhydroxy compounds as stabilizing addenda. Such compounds will typically be leached into the color developing solution and it has now been discovered that because they are likely to complex with trace metal impurities there is a resulting serious problem of loss of the hydroxylamine compound in the developing solution. This loss is a result of the fact that the complex formed by interaction of the aromatic polyhydroxy compound with the trace metal impurity catalyzes the oxidation of the hydroxylamine compound.

Consider, for example, a photographic system in which manganese is present as an impurity in the gelatin of the photographic element, in which 4,5-dihydroxybenzene-1,3-disulfonic acid is incorporated in the photographic element as a stabilizer, and in which N,N-diethylhydroxylamine is present in the developing solution to protect the developing agent against aerial oxidation. Both the manganese and the 4,5-dihydroxybenzene-1,3-disulfonic acid will be leached from the photographic element into the color developing solution and they will interact to form a complex. This complex catalyzes the oxidation of the N,N-diethylhydroxylamine in accordance with the following reaction:

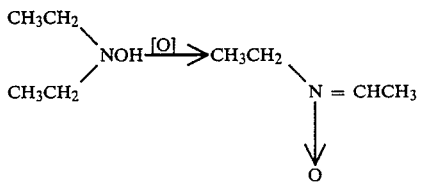

A typical seasoning level for the 4,5-dihydroxybenzene-1,3-disulfonic acid is about 0.2 to 2 grams per liter of developing solution. (This compound would typically be utilized in a photographic element as a stabilizing addendum in the emulsion in an amount of about 0.05 to about 50 grams per mole of silver.) A typical seasoning level for manganese which is present as an impurity in the gelatin is about three parts per million.

Similar trace metal catalyzed oxidation can occur with other hydroxylamines, with other complexing agents and with other trace metal impurities such as copper, nickel, zinc, and cobalt. It is believed that most metals which form complexes with aromatic polyhydroxy compounds will exhibit similar catalytic activity and, accordingly, are detrimental to the stability of color developing solutions containing hydroxylamines.

Although the aminopolycarboxylic acid sequestering agents have been widely used in photographic processing to prevent the formation of calcium precipitates; they have not been heretofore proposed for use for the purpose of preventing oxidation of hydroxylamine compounds caused by the presence of a complex of a metal with a polyhydroxy aromatic compound. The present invention is based in part on the discovery that the problem of hydroxylamine decomposition is a result of the formation of a metal complex of the aromatic polyhydroxy compound and in part on the unexpected solution to this problem that is achieved by the use of a suitable amount of an aminopolycarboxylic acid sequestering agent.

The exact mechanism whereby the invention functions is not understood and the chemical interactions involved appear to be quite complex. Thus, for example, the presence of iron in the developing solution has not been found to cause the problem that is caused by such trace metal impurities as manganese. Moreover, such common sequestering agents as the hydroxylalkylidene diphosphonic acids, which are frequently used in photographic color developers, are not effective in solving the problem which applicants have solved by the use of an aminopolycarboxylic acid sequestering agent.

The aminopolycarboxylic acid sequestering agents are well known and widely used in photographic processing. Typical examples of the aminopolycarboxylic acid sequestering agents include:

nitrilotriacetic acid, (NTA),
ethylenediaminetetracetic acid, (EDTA),
1,3-propylenediaminetetraacetic acid (PDTA),
1-3-diamino-2-propanol-N,N,N',N'-tetraacetic acid (DPTA),
diethylenetriaminepentaacetic acid (DTPA),,
N,N'-bis(2-hydroxybenzyl) ethylenediamine-N,N'-diacetic acid (HBED),
hydroxyethylethylenediaminetriacetic acid,
cyclohexanediaminotetraacetic acid,
aminomalonic acid,
and the like.

The photographic color developing compositions utilized in the method of this invention are employed in the form of aqueous alkaline working solutions having a pH of above 7 and most typically in the range of from about 9 to about 13. To provide the necessary pH, they typically contain one or more of the well known and widely used pH buffering agents, such as the alkali metal carbonates or phosphates. Potassium carbonate is especially useful as a pH buffering agent.

The color developing compositions utilized in the method of this invention typically contain one or more sequestering agents, whose purpose is to sequester calcium and thereby prevent the formation of unwanted precipitates. One class of useful sequestering agents for this purpose are the hydroxyalkylidenediphosphonic acid sequestering agents of the formula:

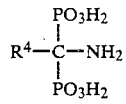

where R is alkyl of 1 to 5 carbon atoms.

Another class of sequestering agents useful for sequestering calcium in photographic color developing compositions are the aminopolyphosphonic acid sequestering agents. The aminopolyphosphonic acid sequestering agents can be utilized in the form of a free acid or in the form of a water-soluble salt. Among the useful aminopolyphosphonic acid sequestering agents are the following:

(1) amino-N,N-dimethylenephosphonic acids of the formula:

$$R^3—N(CH_2PO_3M_2)_2$$

wherein M is a hydrogen atom or a monovalent cation and $R^3$ is an alkyl group, an aryl group, an aralkyl group, an alkaryl group, an alicyclic group or a heterocyclic radical, and $R^3$ can be further substituted with substituents such as hydroxyl, halogen, an alkoxy group, a—$PO_3M_2$ group, a —$CH_2PO_3M_2$ group, or an —$N(CH_2PO_3M_2)_2$ group:

(2) aminodiphosphonic acids of the formula:

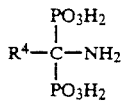

in which $R^4$ is an alkyl group, preferably of one to five carbon atoms, and (3) N-acylaminodiphosphonic acids of the formula:

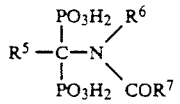

where $R^5$, $R^6$ and $R^7$ are hydrogen or an alkyl group, preferably alkyl of one to five carbon atoms.

Typical examples of the aminopolyphosphonic acid sequestering agents useful in the color developing compositions employed in the method of this invention include:

1-aminoethane-1,1-diphosphonic acid,
1-aminopropane-1,1-diphosphonic acid,
N-acetyl-1-aminoethane-1,1-diphosphonic acid,
ethylenediamine-N,N,N',N'-tetramethylenephosphonic acid,
nitrilo-N,N,N-trimethylenephosphonic acid,
1,2-cyclohexanediamine-N,N,N',N'-tetramethylenephosphonic acid,
o-carboxyanilino-N,N-dimethylenephosphonic acid
propylamino-N,N-dimethylenephosphonic acid,
4-(N-pyrrolidino)butylamine-N,N-bis(methylene phosphonic) acid
1,3-diaminopropanol-N,N,N',N'-tetramethylenephosphonic acid,
1,3-propanediamine-N,N,N',N'-tetramethylenephosphonic acid,
1,6-hexanediamine-N,N,N',N'-tetramethylenephosphonic acid,
o-acetamidobenzylamino-N,N-dimethylenephosphonic acid
o-toluidine-N,N-dimethylenephosphonic acid,
2-pyridylamino-N',N'-dimethylenephosphonic acid,
diethylenetriamine pentamethylenephosphonic acid,
and the like.

Additional ingredients which can optionally be included in the photographic color developing compositions include thickening agents, brightening agents, wetting agents, stain reducing agents, and so forth.

In the color developing solutions employed in the method of this invention, the hydroxylamine compound is typically employed in an amount of from about 0.5 to about 8 moles per mole of primary aromatic amino color developing agent and the aminopolycarboxylic acid sequestering agent is typically employed in an amount of from about 0.05 to about 1.5 moles per mole of primary aromatic amino color developing agent.

Development of photographic elements in accordance with the method described herein can be advantageously employed in the processing of photographic elements designed for reversal color processing or in the processing of negative color elements or color print materials. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

The invention is further illustrated by the following examples of its practice.

EXAMPLES 1–4

A photographic color developing solution that is especially adapted for use with high chloride silver halide photographic elements, hereinafter referred to as Developer 1, was formulated as follows:

| Component | Concentration |
|---|---|
| Lithium salt of sulfonated polystyrene(1) | 0.25 mL/L |
| Triethanolamine(2) | 11.0 mL/L |
| N,N-diethylhydroxylamine(3) | 6.0 mL/L |
| Stain reducing agent(4) | 2.3 g/L |
| Lithium sulfate | 2.7 g/L |
| 1-hydroxyethylidene-1,1-diphosphonic acid(5) | 0.8 mL/L |
| Potassium chloride | 1.8 g/L |
| Potassium bromide | 0.02 g/L |
| Color developing agent(6) | 4.85 g/L |
| Potassium carbonate | 25.0 g/L |
| Water to one liter | |
| pH = 10.12 | |

(1)30% by weight aqueous solution.
(2)85% by weight aqueous solution.
(3)85% by weight aqueous solution.
(4)A stilbene compound available under the trademark KODAK EKTAPRINT 2 Stain-Reducing Agent from Eastman Kodak Company.
(5)60% by weight aqueous solution.
(6)4-(N-ethyl-N-2-methanesulfonylaminoethyl)-2-methylphenylenediaminesesquisulfate mono-hydrate.

To evaluate the stability of Developer 1, and the effect on its stability of additions of aminopolycarboxylic acid sequestering agents, tests were carried out in one-liter graduated cylinders with the developing solution being subject to aeration to accelerate the reactions. To simulate seasoning, 4.5-dihydroxybenzene-1,3-disulfonic acid, referred to hereinafter as CDS, was added to the developing solution, in amounts as indicated below, and manganese was added to the developing solution, in amounts as indicated below, in the form of $MnCl_2.4H_2O$. The developing solutions were analyzed by gas chromatography to determine the concentration of N,N-diethylhydroxylamine and the reaction rate for its decomposition in milliliters per hour was calculated.

Developing solutions evaluated were as follows:

Developer 1
Developer 2=Developer 1 plus 3 ppm Mn and 0.3 g/l CDS
Developer 3=Developer 1 plus 0.6 g/l CDS
Developer 4=Developer 1 plus 10 ppm Mn
Developer 5=Developer 1 plus 10 ppm Mn and 0.6 g/l CDS
Developer 6=Developer 2 plus 1.0 g/l 1,3-diamino-3-propanol-N,N,N',N'-tetraacetic acid
Developer 7=Developer 2 plus 1.0 g/l diethylenetriaminepentaacetic acid
Developer 8=Developer 2 plus 1.0 g/l ethylenediaminetetraacetic acid
Developer 9=Developer 2 plus 1.0 g/l 1.3-propylenediaminetetraacetic acid Results obtained were as follows:

| Test No. | Developing Solution | Decomposition Rate (ml/hour) |
|---|---|---|
| Control 1 | Developer 1 | 0.13 |
| Control 2 | Developer 2 | 0.19 |
| Control 3 | Developer 3 | 0.14 |
| Control 4 | Developer 4 | 0.15 |
| Control 5 | Developer 5 | 0.22 |
| Example 1 | Developer 6 | 0.13 |
| Example 2 | Developer 7 | 0.13 |
| Example 3 | Developer 8 | 0.12 |
| Example 4 | Developer 9 | 0.13 |

Considering the above results, it is noted that high rates of decomposition were observed in Control Tests 2 and 5 in which both Mn and CDS were added, but no aminopolycarboxylic acid sequestering agent was added. The rate was higher in Control Test 5, as compared with Control Test 2, because of the greater concentrations of both Mn and CDS employed to simulate higher seasoning levels. In Control Tests 3 and 4, the rate was similar to Control Test 1 because Control Test 3 involved addition of CDS alone and Control Test 4 involved addition of Mn alone, whereas the problem which is solved by the present invention arises when both are present in the developing solution as seasoning products. Examples 1 to 4 demonstrate that use of aminopolycarboxylic acid sequestering agents, in accordance with the present invention, enables both Mn and CDS to be present in the developing solution without the decomposition rate being any greater than in Control Test 1.

The improved method of color development described herein is based on both the discovery that a product of the interaction of an aromatic polyhydroxy compound, such as CDS, and a trace metal impurity, such as Mn, is responsible for catalyzing the decomposition of hydroxylamine compounds as the developing solution becomes seasoned and the discovery that the well known class of aminopolycarboxylic acid sequestering agents alleviates this problem in a very effective manner. The problem does not occur with photographic elements which do not contain aromatic polyhydroxy compounds nor does it occur in a system that is completely free of trace metal impurities.

The invention has been described in detail with particular reference to certain preferred embodiments thereof, but it will be understood that variations and modifications can be effected within the spirit and scope of the invention.

We claim:

1. In a method for color development of a photographic element comprising at least one silver halide emulsion layer by contacting said element with a color developing solution containing a primary aromatic amino color developing agent and at least one hydroxylamine compound which functions to retard aerial oxidation of said developing solution, said element containing at least one trace metal impurity selected from the group consisting of manganese, copper, nickel, zinc and cobalt and at least one aromatic polyhydroxy compound which functions therein as a stabilizing addendum, said metal impurity and said aromatic polyhydroxy compound being leached into said color developing solution during said color development and interacting therein to form a metal-complex which is capable of catalyzing the oxidation of said hydroxylamine compound; the improvement wherein said color developing solution is protected against said catalyzed oxidation by incorporation therein of an effective amount of an aminopolycarboxylic acid sequestering agent.

2. The method as claimed in claim 1 wherein said hydroxylamine compound is an N,N-dialkylhydroxylamine.

3. The method as claimed in claim 1 wherein said hydroxylamine compound is N,N-diethylhydroxylamine.

4. The method as claimed in claim 1 wherein said metal impurity is manganese.

5. The method as claimed in claim 1 wherein said aromatic polyhydroxy compound is 4,5-dihydroxybenzene-1,3-disulfonic acid.

6. The method as claimed in claim 1 wherein said aminopolycarboxylic acid sequestering agent is ethylenediaminetetraacetic acid.

7. The method as claimed in claim 1 wherein said aminopolycarboxylic acid is 1,3-diamino-2-propanol-N,N,N',N'-tetraacetic acid.

8. The method as claimed in claim 1 wherein said aminopolycarboxylic acid is 1,3-propylenediaminetetraacetic acid.

9. The method as claimed in claim 1 wherein said aminopolycarboxylic acid is diethylenetriaminepentaacetic acid.

10. In a method for color development of a photographic element comprising at least one silver halide emulsion layer by contacting said element with a color developing solution containing a primary aromatic amino color developing agent and a sufficient amount of N,N-diethylhydroxylamine to retard aerial oxidation of said developing solution, said element containing trace amounts of manganese and a sufficient amount of 4,5-dihydroxybenzene-1,3-disulfonic acid to function as a stabilizing addendum, said manganese and said 4,5-hydroxybenzene-1,3-disulfonic acid being leached into said color developing solution during said color development and interacting therein to form a complex which is capable of catalyzing the oxidation of said N,N-diethylhydroxylamine; the improvement wherein said color developing solution is protected against said catalyzed oxidation by incorporation therein of an effective amount of diethylenetriaminepentaacetic acid.

* * * * *